US005456180A

United States Patent [19]

Theurer et al.

[11] Patent Number: 5,456,180

[45] Date of Patent: Oct. 10, 1995

[54] MACHINE FOR REHABILITATING A BALLAST BED

[75] Inventors: Josef Theurer, Vienna; Herbert Wörgötter, Gallneukirchen; Friedrich Oellerer, Linz, all of Austria

[73] Assignee: Franz Plasser Bahnbaumaschinen-Industriegesellschaft m.b.H., Vienna, Austria

[21] Appl. No.: 184,285

[22] Filed: Jan. 21, 1994

[30] Foreign Application Priority Data

Jan. 29, 1993 [AT] Austria ..... A 151/93

[51] Int. Cl.[6] ..... E01B 27/00

[52] U.S. Cl. ..... 104/2; 104/7.1; 104/7.3; 104/12

[58] Field of Search ..... 104/2, 7.1, 7.2, 104/7.3, 12; 37/104, 105

[56] References Cited

U.S. PATENT DOCUMENTS

| | | | |
|---|---|---|---|
| 4,221,169 | 9/1980 | Theurer | 104/12 |
| 4,430,944 | 2/1984 | Theurer | 104/2 |
| 4,479,439 | 10/1984 | Theurer et al. . | |
| 4,627,358 | 12/1986 | Theurer . | |
| 4,643,101 | 2/1987 | Theurer . | |
| 4,770,104 | 9/1988 | Theurer | 104/7.3 |
| 4,794,862 | 1/1989 | Theurer . | |
| 4,799,430 | 1/1989 | Theurer | 104/2 |
| 5,052,133 | 10/1991 | Mohr | 37/104 |
| 5,172,635 | 12/1992 | Theurer | 104/2 |
| 5,172,636 | 12/1992 | Theurer et al. . | |
| 5,329,856 | 7/1994 | Lorscheider | 104/2 |

*Primary Examiner*—Mark T. Le
*Attorney, Agent, or Firm*—Collard & Roe

[57] ABSTRACT

A mobile machine for rehabilitating a ballast bed comprises an elongated machine frame supported by spaced apart undercarriages on the track for mobility in an operating direction. Mounted on the machine frame between the undercarriages are a vertically adjustable device for excavating ballast, a ballast discharge device arranged rearwardly of the ballast excavating device in the operating direction, the ballast discharge device having a discharge end, and a track lifting device and a vertically adjustable ballast tamping head arranged rearwardly of the discharge end of the ballast discharge device. The track lifting device comprises flanged rollers supporting the track lifting device on the track, and the ballast tamping head comprises reciprocable tamping tools for tamping the discharged ballast. The track lifting device and the ballast tamping head are mounted on a common carrier frame, and a longitudinal displacement drive displaces the common carrier frame in the longitudinal direction relative to the machine frame.

8 Claims, 2 Drawing Sheets

Fig. 2
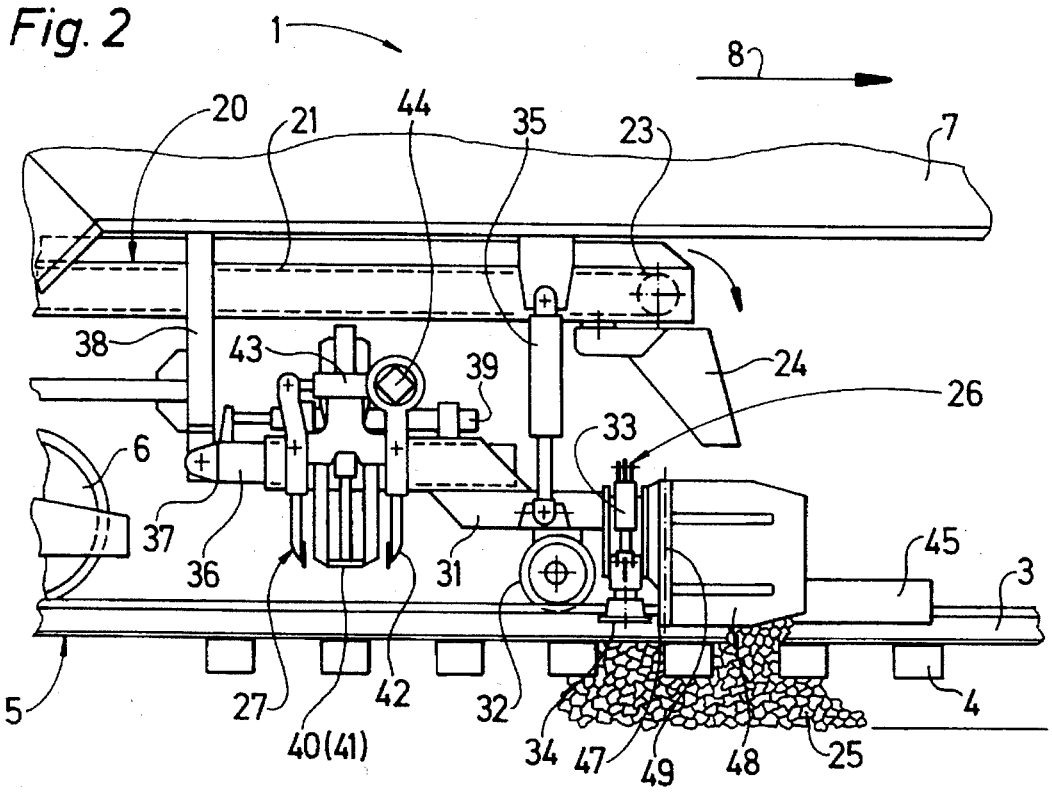
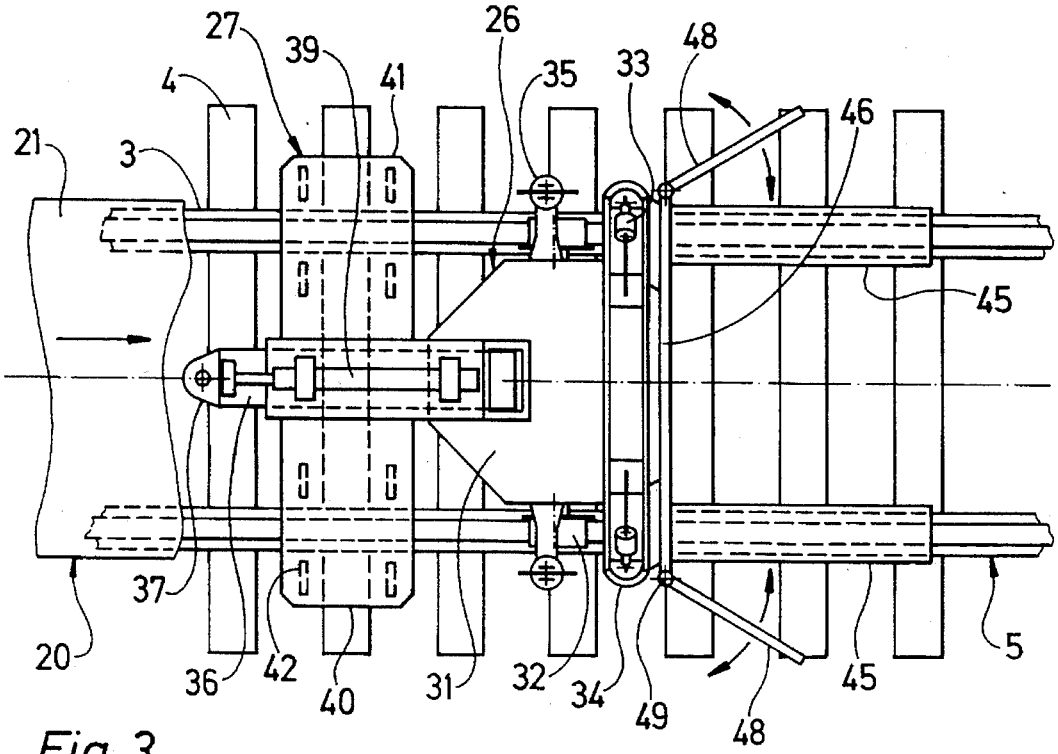
Fig. 3

MACHINE FOR REHABILITATING A BALLAST BED

BACKGROUND OF THE INVENTION

1. Field of the Invention

The present invention relates to a mobile machine for rehabilitating a ballast bed supporting a track comprising two rails fastened to ties, each rail having a field side and a gage side, which comprises an elongated machine frame extending in a longitudinal direction and supported by spaced apart undercarriages on the track for mobility in an operating direction, and mounted on the machine frame between the undercarriages a vertically adjustable device for excavating ballast, a ballast discharge device arranged rearwardly of the ballast excavating device in the operating direction, the ballast discharge device having a discharge end, a track lifting device and a vertically adjustable ballast tamping head, the track lifting device comprising flanged rollers supporting the track lifting device on the track, and the ballast tamping head comprising reciprocable tamping tools for tamping the discharged ballast.

2. Description of the Prior Art

U.S. Pat. No. 5,172,636 discloses a ballast cleaning machine with an elongated, bridge-like machine frame whose opposite ends are supported on undercarriages running on a track. The ballast is excavated by an endless excavating chain running under the track centrally between the undercarriages, and the excavated ballast is transported by a conveyor arrangement to a ballast screening car which is coupled to the machine and precedes the same in the operating direction. A further conveyor arrangement transports the cleaned ballast from the ballast screening car rearwardly to a ballast discharge device located behind the excavating point, and the ballast discharge device has an elongated discharge conveyor associated with each track rail and pivotal in a horizontal plane. Ballast discharge chutes are affixed to a track lifting unit underneath the discharge ends of the discharge conveyors for distributing the cleaned ballast adjacent each rail. The track lifting unit is linked to the machine frame and has flanged rollers running on the track rails, and it is equipped with a vibrator for vibrating the track and the ballast discharged underneath it so that the ballast flow is improved. Two vertically adjustable ballast tamping heads are mounted on the machine frame rearwardly of the track lifting unit in the operating direction and their tamping tools are immersed in the shoulder ballast at opposite ends of the ties for shovelling the lowest layer of the shoulder ballast up to the area adjacent the tie ends where the ballast is compacted by pressing it under the ties. This machine is very long and, therefore, cannot be used under all track conditions.

U.S. Pat. No. 4,794,862 discloses a track leveling and ballast tamping machine equipped with means for delivering additional ballast for effective tamping. For this purpose, a ballast storage bin is mounted on a machine frame between the undercarriages supporting the same on the track, and the bin has outlet openings for discharging ballast into the cribs. A track lifting and lining unit as well as a tamping unit are mounted on guides on the machine frame rearwardly of the ballast outlet openings, and these units are longitudinally displaceable in unison so that the machine may be advanced continuously while tamping is effectuated intermittently. This machine is used in combination with a track renewal train or behind a ballast cleaning machine.

U.S. Pat. No. 4,479,439 discloses a machine arrangement for rehabilitating the subgrade of a track. The arrangement comprises a series of work vehicles which are coupled together, and each vehicle carries different operating tools. The ballast bed under a lifted track is removed by a ballast excavating chain and conveyed forwardly in the operating direction. A layer of sand is then laid on the exposed subgrade, planed and uniformly compacted. A ballast discharge device then lays a new ballast bed on the sand layer, and a satellite vehicle carrying a tamping unit may then tamp the new ballast bed. The tamping unit and the associated track lifting unit may be longitudinally displaceable on the machine frame of the satellite vehicle so that the tamping unit may be longitudinally displaced during tamping at the same rate of speed as the forward speed of the entire machine arrangement so that the arrangement may be advanced continuously. This machine arrangement is quite long and, therefore, its usefulness is limited.

SUMMARY OF THE INVENTION

It is the primary object of this invention to improve a machine of the first-described type by providing a structurally simple operating unit for delivering ballast to the track.

The above and other objects are accomplished according to the invention with a mobile machine for rehabilitating a ballast bed supporting a track comprising two rails fastened to ties, each rail having a field side and a gage side, which comprises an elongated machine frame extending in a longitudinal direction and supported by spaced apart undercarriages on the track for mobility in an operating direction, and mounted on the machine frame between the undercarriages a vertically adjustable device for excavating ballast, a ballast discharge device arranged rearwardly of the ballast excavating device in the operating direction, the ballast discharge device having a discharge end. A track lifting device and a vertically adjustable ballast tamping head are mounted on the machine frame rearwardly of the discharge end of the ballast discharge device, the track lifting device comprising flanged rollers supporting the track lifting device on the track, and the ballast tamping head comprising reciprocable tamping tools for tamping the discharged ballast. The track lifting device and the ballast tamping head are mounted on a common carrier frame, and a longitudinal displacement drive displaces the common carrier frame in the longitudinal direction relative to the machine frame.

This machine considerably enhances the delivery of ballast to the track and thus optimizes a ballast bed rehabilitation operation. The discharged ballast can flow under the ties lifted by the track lifting unit and is tamped immediately by the adjacent tamping unit before the rear undercarriage of the economically advantageously continuously advancing machine frame presses the new ballast down. This advantageously produces a considerably improved track position immediately after the machine operation and leaves the track with its new ballast bed in a sufficiently good condition to permit trains to pass over this rehabilitated track up to a certain speed without the need for further track maintenance work. Furthermore, the carrier frame may be relatively short without in any way reducing the operating capacity of the tools mounted thereon. In this way, a very compact machine with a high operating capacity is obtained, which can be used under track conditions which do not permit the use of long machine arrangements.

If the flanged rollers support the common carrier on the track at a front end thereof, in the operating direction, the frame of the track lifting device can also support the tamping head. Therefore, the tamping head need no longer be mounted on the machine frame, and this makes it possible to arrange the ballast discharge device directly above these units along the machine frame without any hindrance.

Preferably, a guide rod extends in the longitudinal direction and slidably supports the common carrier at a rear end thereof, in the operating direction, a rear end of the guide rod being linked to the machine frame by a universal joint immediately ahead of a rear one of the undercarriages, in the operating direction. This is a structurally very simple arrangement for the longitudinal guidance of the common carrier and the transverse adjustment of the track lifting and tamping devices so that the machine may be effectively used in track curves.

According to a preferred embodiment, the ballast tamping head is arranged rearwardly of the track lifting device, in the operating direction, and comprises a respective tamping tool unit associated with each track rail, each tamping tool unit comprising a pair of tamping tools reciprocable in the longitudinal direction and a common drive linked to upper ends of the tamping tools for reciprocating the tamping tools. A crank drive is connected to the upper end of one of the tamping tools. Such a tamping head is particularly advantageous for use in such a compact machine because it is also compact and relatively light, which is advantageous with respect to the reduced stress on the common carrier.

The discharged ballast will be optimally directed to the desired spots of the ballast bed at the intersections of the rails and ties, and the rails will at the same time be protected from the falling ballast if a respective chute is arranged above each track rail at the discharge end of the ballast discharge device, a tunnel is arranged below each chute to cover each track rail, each track rail covering tunnel being attached to the common carrier frame at a front end thereof, in the operating direction, and each track rail covering tunnel has a length exceeding that of the displacement path of the common carrier frame.

The ballast distribution will be further improved by the use of a vertical front plate connecting the track rail covering tunnels at the front end of the common carrier frame, the vertical front plate extending perpendicularly to the longitudinal direction and having a lower edge extending parallel to the track ties, the lower front plate edge being positioned immediately above the ties when the track lifting device is in operation, and a vertical ballast plowshare at respective front plate ends spaced apart in a direction extending perpendicularly to the longitudinal direction, the plowshare being pivoted to the front plate ends for pivoting about vertical axes adjacent the field side of each track rail. The pivotal plowshares will accurately limit the distribution of the ballast at the track shoulders and the front plate will rationally push the continuously discharged ballast accumulating on the ties into the adjacent cribs.

The ballast distribution will be further improved by accurately directing the ballast discharge if the ballast discharge device comprises a conveyor band extending in the longitudinal direction and being mounted on the machine frame for displacement in the longitudinal direction, the conveyor band being coupled to the common carrier frame for common longitudinal displacement therewith. In this way, the discharge end of the conveyor band is displaced from tie to tie together with the tamping head and the track lifting device. This enables the ballast to be poured directly into the cribs and to reduce the amount of the ballast falling onto the ties to a minimum.

BRIEF DESCRIPTION OF THE DRAWING

The above and other objects, advantages and features of the present invention will become more apparent from the following detailed description of certain now preferred embodiments thereof, taken in conjunction with the accompanying somewhat schematic drawing wherein

FIG. 2 is an enlarged fragmentary side elevation showing the track lifting device and tamping head of the machine;

FIG. 3 is a diagrammatic top view of the track lifting device and tamping head of FIG. 2.

DETAILED DESCRIPTION OF THE PREFERRED EMBODIMENTS

Figure 1:
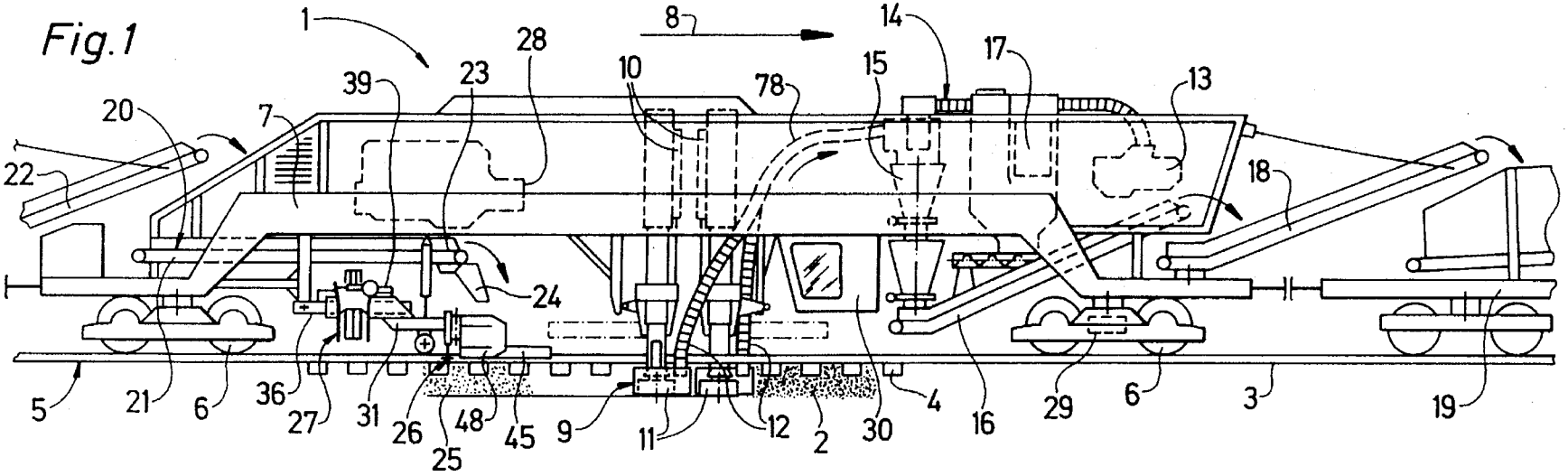
FIG. 1 is a side elevational view of a mobile ballast bed rehabilitating machine showing one embodiment of this invention.

Referring first to the embodiment shown in FIGS. 1 to 3, there is shown mobile machine 1 for rehabilitating ballast bed 2 supporting track 5 comprising two rails 3 fastened to ties 4. Each rail 3 has a field side and a gage side. The machine comprises elongated, bridge-like machine frame 7 extending in a longitudinal direction and supported by spaced apart undercarriages 6, 6 on track 5 for mobility in an operating direction indicated by arrow 8.

Mounted on machine frame 7 between undercarriages 6 are vertically adjustable device 9 for excavating ballast, ballast discharge device 20 arranged rearwardly of ballast excavating device 9 in the operating direction, track lifting device 26 and vertically adjustable ballast tamping head 27 arranged rearwardly of discharge end 23 of ballast discharge device 20. The track lifting device comprises flanged rollers 32 supporting track lifting device 26 on track 5, and ballast tamping head 27 comprises reciprocable tamping tools 42 for tamping the discharged ballast. Common carrier frame 31 carries the track lifting device and the ballast tamping head, and longitudinal displacement drive 39 displaces the common carrier frame in the longitudinal direction relative to machine frame 7.

The ballast excavating device is vertically adjustably linked to machine frame 7 by drives 10 substantially centrally between undercarriages 2 and is comprised of two excavating elements 11. In the operating position illustrated in FIG. 1, the excavating elements have been lowered below ties 4 and have been swung transversely to extend under the track so that they can excavate ballast bed 2 and convey the excavated ballast to the track shoulders. The ballast is removed by ballast removal device 14 comprised of two vacuum tubes 12 at the track shoulders and suction hose 78 delivering the sucked-up ballast from the vacuum tubes to cyclone separator 15 which is connected to compressor 13. The ballast is discharged from the cyclone separator onto waste removal conveyor band 16. An air filter 17 arranged between the separator and the compressor separates the dust contained in the suction air, and this dust also falls on conveyor band 16 which conveys the waste material to transfer conveyor 18 discharging the waste material into silo car 19 which is coupled to the front end of machine frame 7. Ballast aspirating device 14 is fully described and is claimed in our simultaneously filed application entitled "Machine for Aspirating Ballast from a Ballast Bed".

As best shown in FIG. 2, flanged rollers 32 support common carrier frame 31 on track 5 at a front end thereof, in the operating direction. Guide rod 36 extending in the longitudinal direction centrally between the track rails slidably supports common carrier frame 31 at a rear end thereof, in the operating direction, the carrier frame rear end having a bore receiving the guide rod. Rear end 37 of the guide rod is linked to bracket 38 of machine frame 7 by a universal joint immediately ahead of rear undercarriage 6, in the operating direction. Hydraulic drive 39 is mounted on common carrier frame 31 and linked to rear end 37 for longitudinally displacing the common carrier frame along guide rod 36. The common carrier frame extends in the longitudinal direction and track lifting device 26 is mounted at a front end of the common carrier frame and comprises flanged rollers 32 and rail lifting rollers 34 for engaging track rails 3. Drives 33 are connected to the lifting rollers to pivot them into and out of engagement with the track rails, and the track lifting device is vertically adjustable by lifting drives 35 linking common carrier frame 31 to machine frame 7.

As shown in FIG. 3, ballast tamping head 27 is arranged rearwardly of track lifting device 26, in the operating direction, and comprises a respective vertically adjustable tamping tool unit 40, 41 associated with each track rail. Each tamping tool unit comprises a pair of tamping tools 42 reciprocable in the longitudinal direction and a common drive 43 linked to upper ends of tamping tools 42 for reciprocating the tamping tools. Crank drive 44 at the upper end of one of the tamping tools enables both tamping tools of the unit to be vibrated.

Ballast discharge device 20 at the rear end of machine frame 7 comprises conveyor band 21 extending in the longitudinal direction. The conveyor band has a rear input end for receiving clean ballast 25 from transfer conveyor 22 leading to machine 1 from a silo car coupled to the rear end of the machine and a respective chute 24 arranged above each track rail 3 at discharge end 23 of the ballast discharge device for discharging clean ballast 25 on the subgrade exposed by the preceding excavation of ballast bed 2. The clean ballast is tamped by tamping head 27 and the track may be lifted before tamping to a desired level by track lifting device 26.

Central power plant 28 on machine frame 7 supplies power to all the operating drives as well as drive 29 which propels the machine. Operator's cab 30 is mounted on the machine frame within sight of ballast excavating device 9.

As best shown in FIGS. 2 and 3, a tunnel 45 is arranged below each chute 24 to cover each track rail 3. Each track rail covering tunnel 45 is attached to common carrier frame 31 at a front end thereof, in the operating direction. Each track rail covering tunnel 45 has a length exceeding that of the displacement path of the common carrier frame. A vertical front plate 46 connects track rail covering tunnels 45 at the front end of common carrier frame 31 immediately behind chutes 24, the vertical front plate extending perpendicularly to the longitudinal direction and having a lower edge 47 extending parallel to track ties 4. Lower front plate edge 47 is positioned immediately above the ties when the track lifting device is in operation, as illustrated in FIG. 2. Vertical ballast plowshares 48 at respective front plate ends are spaced apart in a direction extending perpendicularly to the longitudinal direction, the plowshares being pivoted to the front plate ends for pivoting about vertical axes 49 adjacent the field side of each track rail 3.

In operation, machine 1 advances continuously in the operating direction indicated by arrow 8, ballast excavating device 9 is operated to excavate ballast bed 2 under track 5 and to remove the excavated ballast by suction device 14 which delivers it by conveyor bands 16 and 18 to silo car 19. At the same time, common carrier frame 31 with track lifting device 26 and tamping head 27 is cyclically displaced from tie to tie by longitudinal displacement drive 39. Meanwhile, clean ballast 25 is continuously delivered by conveyor bands 22 and 21 to discharge chutes 24 which distribute the clean ballast over the exposed subgrade. Any accumulating ballast is removed from the ties or planed in the cribs by front plate 46 whose lower edge 47 engages such ballast accumulations as the machine advances while shoulder plowshares 48 shape the ballast in the shoulders.

Figure 4:
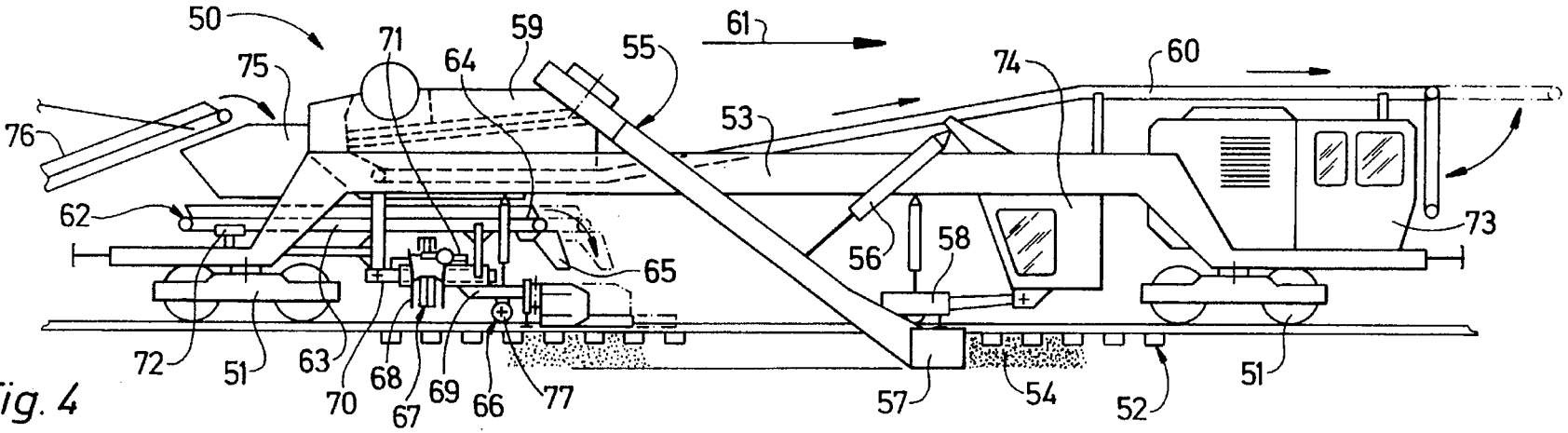
FIG. 4 is a side elevational view of a mobile ballast bed rehabilitating machine showing another embodiment of the invention.

FIG. 4 illustrates a machine 50 whose elongated, bridge-like machine frame 53 is supported on track 52 by undercarriages 51. The machine frame carries driver's cab 73 at a front end thereof and operator's cab 74 within view of ballast excavating device 55 for cleaning ballast bed 54. This ballast excavating device is comprised of a vertically adjustable endless excavating chain 57 which is linked to the machine frame by adjustment drive 56. During excavation, track lifting device 58 engages the track rails with rollers which hold the track in a set vertical position. Screening installation 59 is associated with the excavating chain and receives the excavated ballast from it for cleaning. The waste is separated from the cleaned ballast in the screening installation and is removed by waste removal conveyor band 60 forwardly in the operating direction indicated by arrow 61.

To redistribute the cleaned ballast coming from screening installation 59, conveyor band 63, which extends in the longitudinal direction, is mounted under the screening installation for receiving the cleaned ballast therefrom, and discharge end 64 of the conveyor band leads to discharge chutes 65 associated with the track rails. Cleaned ballast conveyor band 63 is longitudinally displaceably mounted on machine frame 53 by guide 72. Another track lifting device 66 and a vertically adjustable tamping head 67 with reciprocable tamping tools 67 are arranged immediately rearwardly of discharge chutes 65. As in the embodiment described in connection with FIGS. 1–3, the track lifting device and tamping head are mounted on common carrier frame 69 which is longitudinally displaceable on guide rod 70 linked to machine frame 53. Flanged rollers 77 of track lifting device 66 support the common carrier frame on track 52. Cleaned ballast conveyor band is also connected to common carrier frame 69 and is displaced with it (as shown in phantom lines), drive 71 longitudinally displacing the common carrier frame cyclically while machine frame 53 advances continuously along track 52 in the operating direction indicated by arrow 61. An input funnel 75 at the rear of machine frame 53 enables additional clean ballast to be delivered to ballast discharge device 62 if not enough cleaned ballast is obtained from screening installation 59. Such additional clean ballast may be conveyed to input funnel 75 by transfer conveyor band 76 receiving such ballast from a silo car coupled to the rear end of machine frame 53. Ballast cleaning machine 50 operates substantially in the same manner as machine 1.

What is claimed is:

1. A mobile machine for rehabilitating a ballast bed supporting a track comprising two rails fastened to ties, each rail having a field side and a gage side, which comprises (a) an elongated machine frame extending in a longitudinal direction and supported by spaced apart undercarriages on the track for mobility in an operating direction, and the following structures mounted on the machine frame between the undercarriages:

(b) a vertically adjustable device for excavating ballast, (c) a ballast discharge device arranged rearwardly of the ballast excavating device in the operating direction, the ballast discharge device having (1) a discharge end, (d) a track lifting device and a vertically adjustable ballast tamping head arranged rearwardly of the discharge end of the ballast discharge device, the track lifting device comprising (1) flanged rollers supporting the track lifting device on the track, and the ballast tamping head comprising (2) reciprocable tamping tools for tamping the discharged ballast, (e) a common carrier frame for the track lifting device and the ballast tamping head, (1) the flanged rollers supporting the common carrier frame on the track at a front end of the common carrier frame, in the operating direction, and (f) a longitudinal displacement drive for displacing the common carrier frame in the longitudinal direction relative to the machine frame.

2. The mobile ballast rehabilitating machine of claim 1, further comprising a guide rod extending in the longitudinal direction and slidably supporting the common carrier frame at a rear end of the carrier frame in the operating direction, a rear end of the guide rod being linked to the machine frame by a universal joint immediately ahead of a rear one of the undercarriages, in the operating direction.

3. The mobile ballast rehabilitating machine of claim 1, wherein the ballast tamping head is arranged rearwardly of the track lifting device, in the operating direction, and comprises a respective tamping tool unit associated with each track rail, each tamping tool unit comprising a pair of tamping tools reciprocable in the longitudinal direction and a common drive linked to upper ends of the tamping tools for reciprocating the tamping tools.

4. The mobile ballast rehabilitating machine of claim 1, further comprising a respective chute arranged above each track rail at the discharge end of the ballast discharge device.

5. The mobile ballast rehabilitating machine of claim 4, further comprising a tunnel arranged below each chute and covering each track rail, each track rail covering tunnel being attached to the common carrier frame at a front end thereof, in the operating direction.

6. The mobile ballast rehabilitating machine of claim 5, further comprising a vertical front plate connecting the track rail covering tunnels at the front end of the common carrier frame, the vertical front plate extending perpendicularly to the longitudinal direction and having a lower edge extending parallel to the track ties, and the lower front plate edge being positioned immediately above the ties when the track lifting device is in operation.

7. The mobile ballast rehabilitating machine of claim 6, further comprising vertical ballast plowshares at respective front plate ends, the plowshares being spaced apart in a direction extending perpendicularly to the longitudinal direction and being pivoted to the front plate ends for pivoting about vertical axes adjacent the field side of each track rail.

8. A mobile machine for rehabilitating a ballast bed supporting a track comprising two rails fastened to ties, each rail having a field side and a gage side, which comprises (a) an elongated machine frame extending in a longitudinal direction and supported by spaced apart undercarriages on the track for mobility in an operating direction, and the following structures mounted on the machine frame between the undercarriages:

(b) a vertically adjustable device for excavating ballast, (c) a ballast discharge device arranged rearwardly of the ballast excavating device in the operating direction, the ballast discharge device comprising (1) a conveyor band extending in the longitudinal direction and having a discharge end, the conveyor band being mounted on the machine frame for displacement in said direction relative to the machine frame during the ballast bed rehabilitating operation, (d) a track lifting device and a vertically adjustable ballast tamping head arranged rearwardly of the discharge end of the ballast discharge device, the track lifting device comprising (1) flanged rollers supporting the track lifting device on the track, and the ballast tamping head comprising (2) reciprocable tamping tools for tamping the discharged ballast, (e) a common carrier frame for the track lifting device and the ballast tamping head, and (f) a longitudinal displacement drive for displacing the common carrier frame in the longitudinal direction relative to the machine frame, the conveyor band of the ballast discharge device being coupled to the common carrier frame for common longitudinal displacement therewith.

* * * * *